United States Patent [19]

Chern

[11] Patent Number: 5,009,830

[45] Date of Patent: Apr. 23, 1991

[54] ON-LINE FIBER HEAT TREATMENT

[75] Inventor: Terry S. Chern, Richmond, Va.

[73] Assignee: E. I. du Pont de Nemours and Company, Wilmington, Del.

[21] Appl. No.: 326,553

[22] Filed: Mar. 20, 1989

[51] Int. Cl.[5] ..... D01F 6/60; D01D 10/02

[52] U.S. Cl. ..... 264/290.5; 264/234; 264/210.8; 264/345

[58] Field of Search ..... 264/555, 234, 235, 290.5, 264/345, 346, 211.15, 184, 211.16, 331.19, 343, 203, 210.3, 210.8; 528/348

[56] References Cited

U.S. PATENT DOCUMENTS

| | | | |
|---|---|---|---|
| 3,503,231 | 3/1970 | Fleissner et al. | 68/5 |
| 3,869,430 | 3/1975 | Blades | 260/78 |
| 3,969,429 | 3/1975 | Blades | 264/184 |
| 4,374,978 | 2/1983 | Fujiwara et al. | 528/348 |
| 4,419,317 | 12/1983 | Fujiwara et al. | 264/184 |
| 4,440,710 | 4/1984 | Fujiwara et al. | 264/184 |
| 4,883,634 | 11/1989 | Chern et al. | 264/555 |

FOREIGN PATENT DOCUMENTS

| | | |
|---|---|---|
| 0121132 | 10/1984 | European Pat. Off. . |
| 0247889 | 12/1987 | European Pat. Off. . |
| 49-81619 | 8/1974 | Japan . |

*Primary Examiner*—Hubert C. Lorin

[57] ABSTRACT

A process for simultaneously drying and heat treating wet spun fibers of greater than 20 percent water based on weight of dry fiber material supplied continuously in multiple wraps around a pair of rolls in a heated zone, at a tension of 0.2 to 6 grams per denier at the beginning of the zone, with gas jets extending around each of the rolls for about 45 to 180 to direct turbulent gas at a temperature of 200 to 660 C against the fibers under tension in the zone until the residual moisture in the fibers is from 0.5 to 10 percent water based on weight of dry fiber material.

9 Claims, 2 Drawing Sheets

ON-LINE FIBER HEAT TREATMENT

BACKGROUND OF THE INVENTION

1. Field of the Invention

This invention relates to a process and apparatus for simultaneously drying and heat treating never-dried wet spun aramid fibers over tensioning rolls in a single step on a continuous basis.

2. Description of the Prior Art

U.S. Pat. No. 3,503,231 issued Mar. 31, 1970 on the application of Fleissner et al., discloses a continuous conveyer belt system for treating materials, including heat treating yarns. The conveyer must be steam pervious and the treatment does not include drying never-dried, wet spun, yarns.

U.S. Pat. No. 3,869,430 issued Mar. 4, 1975 on the application of Blades, discloses, in a general way, drying and heat treating an unsupported, wet, yarn of poly(p-phenylene terephthalamide).

U.S. Pat. Nos. 4,374,978 issued Feb. 22, 1983 and 4,440,710 issued April 3, 1984, on the applications of Fujiwara et al., disclose a process for making fibers of poly(p-phenylene terephthalamide) by washing and drying them in the absence of any tension and then heat treating them under tension at temperatures of greater than 200° C.

U.S. Pat. No. 4,419,317 issued Dec. 6, 1983 on the application of Fujiwara et al., discloses a process for making fibers of poly(p-phenylene terephthalamide) by washing and treating with saturated steam in the absence of tension.

European Patent Application 121,132 published Oct. 10, 1984 on the application of Akihiro et al., discloses the application of finely divided inorganic particles to wet fibers in order to prevent fiber-to-fiber adhesion. The fibers are dried without drawing and are, then, heat treated under tension.

European Patent Application 247,889 published Dec. 2, 1987 on the application of Chern et al., discloses a process for simultaneously drying and heat treating unsupported never-dried para-aramid fibers under high temperatures and high tensions.

Japanese Patent Laid-Open Publication (Kokai) 49-81619 published Aug. 6, 1974 on the application of Nagasawa et al., discloses a fiber treatment wherein never-dried aramid fibers can be dried and heat treated at the same time.

SUMMARY OF THE INVENTION

The present invention provides an apparatus for drying and heat treating wet spun fibers comprising: at least one fiber carrying roll, said roll being rotatably driven, with gas jets positioned over the roll, and a jet support positioned over the gas jets. The gas jets are normally positioned a substantially constant distance from the roll; and preferably extend around the roll from 15° to 360°. The roll is heated internally for drying the fibers. In a preferred embodiment, the apparatus comprises: at least one pair of fiber carrying rolls; at least one roll of each pair being rotatably driven; gas jets positioned over at least one of the rolls in each pair; and a jet support positioned over the gas jets. When the rolls are used in pairs, the gas jets do not extend around the roll more than about 180 degrees;— from 45 to 180 degrees being preferred.

The present invention, additionally, provides a process for simultaneously drying and heat treating under tension wet spun aramid fibers comprising: supplying continuously to a heated zone aramid fibers of about 20 to greater than 100 percent water based on weight of dry aramid; maintaining a tension of 0.2 to 6.0 grams per denier to the fibers at the beginning of the zone; directing turbulent gas at a temperature of 200 to 660° C. against the fibers under tension in the heated zone until the residual moisture in the fibers is from 0.5 to 10 percent water based on weight of dry aramid; and removing continuously the fibers from the heated zone. The fibers in the heated zone are, generally, conducted in multiple wraps around a roll; and heat is supplied to the heated zone by the turbulent gas and, additionally, by a heated medium inside the roll.

While the process of the present invention is useful as a free-standing process, it is especially useful as an integral element of fiber manufacture wherein the device and process of this invention are substituted for the drying step of the prior art. As an on-line improvement, the process of this invention greatly increases the efficiency of wet and air gap spinning processes. For the purpose of describing this invention, wet spinning processes are taken to embrace processes which spin into a coagulating bath and the term is meant to include air gap spinning.

DETAILED DESCRIPTION OF THE INVENTION

Figure 1:
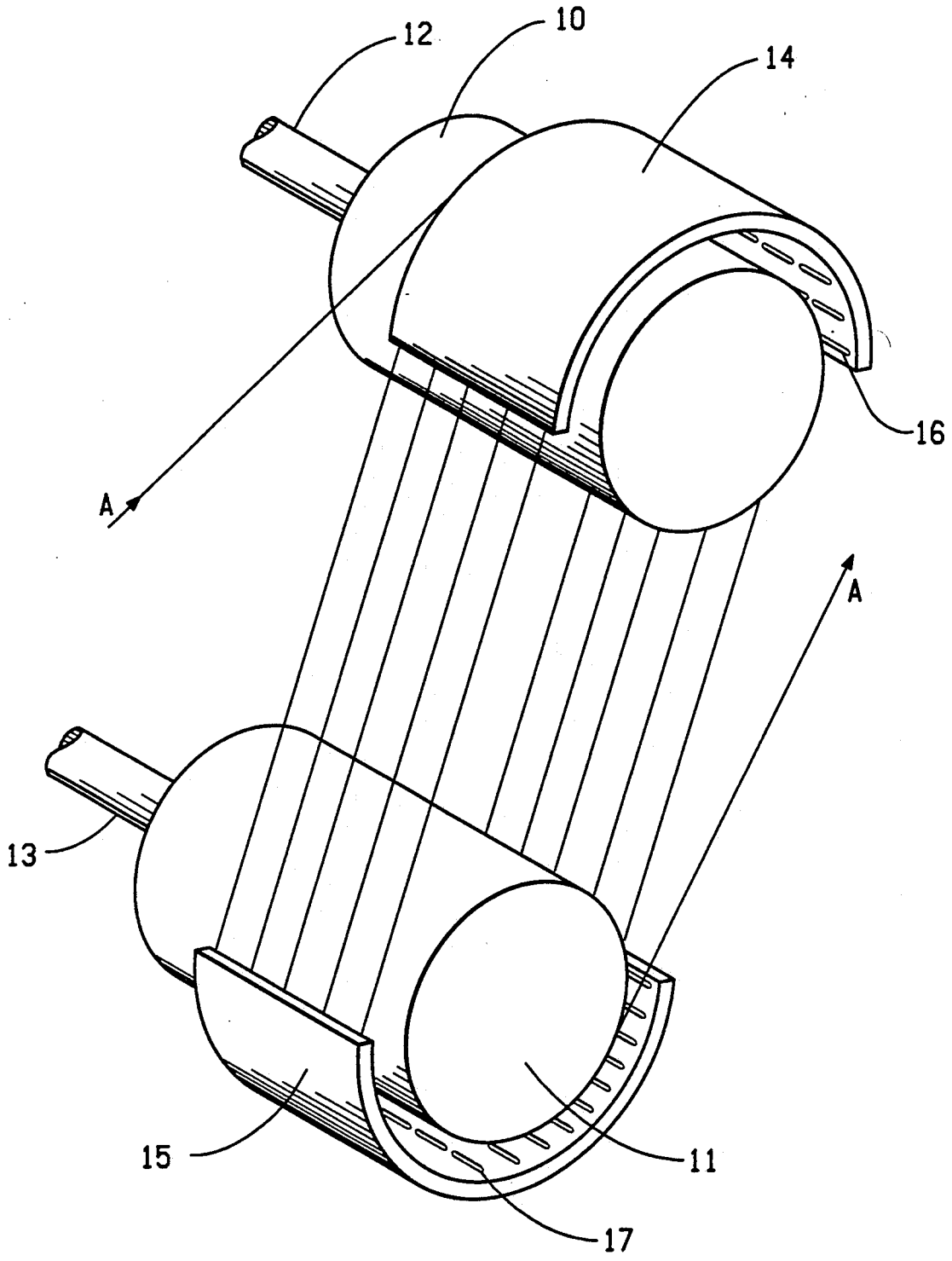
FIG. 1 is a simplified representation, in perspective, of an apparatus of this invention.

The present invention is based on an apparatus and a process for treating fibers, especially poly(p-phenylene terephthalamide) fibers, which yield greatly increased productivity of fibers of high modulus and high tenacity.

By "poly(p-phenylene terephthalamide)" is meant the homopolymer resulting from mole-for-mole polymerization of p-phenylene diamine and terephthaloyl chloride and, also, copolymers resulting from incorporation of small amounts of other aromatic diamine with the p-phenylene diamine and of small amounts of other aromatic diacid chloride with the terephthaloyl chloride. As a general rule, other aromatic diamines and other aromatic diacid chlorides can be used in amounts up to as much as about 10 mole percent of the p-phenylene diamine or the terephthaloyl chloride, or perhaps slightly higher, provided only that the other diamines and diacid chlorides do not unacceptably alter the physical properties of fibers made from the polymer.

The polymer can conveniently be made by any of the well known polymerization processes such as those taught in U.S. 3,063,966, U.S. 3,869,429, and 4,308,374.

Fibers of the present invention can be spun using the conditions specifically set out in U.S. Pat. No. 3,869,429. Dopes are extruded through spinnerets with orifices ranging from about 0.025 to 0.25 mm in diameter, or perhaps slightly larger or smaller. The number, size, shape, and configuration of the orifices are not critical. The extruded dope is conducted into a coagulation bath through a noncoagulating fluid layer. While in the fluid layer, the extruded dope is stretched from as little as 1 to as much as 15 times its initial length (spin stretch factor). The fluid layer is generally air but can be any other inert gas or even liquid which is a non-coagulant for the dope. The noncoagulating fluid layer is generally from 0.1 to 10 centimeters in thickness.

The coagulation bath is aqueous and ranges from pure water, or brine, to as much as 70% sulfuric acid. Bath temperatures can range from below freezing to about 28° C. or, perhaps, slightly higher. It is preferred that the temperature of the coagulation bath be kept below about 10° C., and more preferably, below 5° C., to obtain fibers with the highest initial strength.

After the extruded dope has been conducted through the coagulation bath, the dope has coagulated into a water-swollen fiber. At this point in fiber manufacture, the fiber includes about 50 to 100 percent aqueous coagulation medium, based on dry fiber material, and, for the purposes of this invention, must be thoroughly washed to remove the salt and acid from the interior of the swollen fiber. The fiber-washing solutions can be water or they can be slightly alkaline. The wet and swollen fiber is conducted from washing and neutralization to the device of this invention.

The description of this invention is directed toward the use of fibers which have been newly-spun and never dried to less than 20 percent moisture prior to operation of the process. It is believed that previously-dried fibers cannot successfully be heat treated by this process because the heat treatment is effective only when performed on the polymer molecules at the time that the structure is being dried and ordered into a compact fiber and before the structure has been collapsed by removal of the water.

The device of this invention can be explained by reference to the drawings in which like or corresponding parts are designated by like reference characters throughout the several views, FIG. 1 represents a preferred apparatus for practice of this invention.

Wet-spun, fiber (A) is passed from the coagulating, washing, and neutralization steps (not shown) to fiber carrying roll 10 around which fiber A is wrapped and passed to fiber carrying roll 11. Fiber A makes multiple wraps around the pair of fiber carrying rolls and is then directed from one of the rolls to further treatment or to a packaging station (not shown). Rolls 10 and 11 are rotatably mounted on shafts 12 and 13, respectively, and at least one of the rolls is driven. The rolls are positioned such that the wraps of fiber A automatically advance along the rolls from one end of the roll surface to the other end of the roll surface. A tension of from 0.2 to 6.0 grams per denier is maintained on the fiber when it is introduced to the rolls and the fiber is removed from the rolls at a tension no greater than the tension at fiber introduction. Higher tensions increase the risk of fiber breakage but higher tensions also result in a fiber product of higher modulus.

At least one of rolls 10 and 11 is supplied internally with heating elements. The heat is generally supplied in the form of steam circulated through passages built into the rolls; and is primarily intended for drying the fibers. The temperature of that steam is generally less than 380° C. U.S. Pat. No. 4,644,668, issued Feb. 24, 1987 on the application of R. E. Hull discloses a steam heated roll which would serve for use as roll 10 or 11 of this invention.

Although a pair of rolls is preferred, the invention can be accomplished by the use of a single roll. In the use of a single roll, fiber A is introduced at one end of the single driven roll and makes several advancing wraps around the roll before leaving at the other end of the roll. The single roll would be heated internally and would be fitted with gas jets and a jet support just as is described elsewhere herein. In the use of a single roll, jets can be located to extend for more that 180° around the roll and could be extended to completely surround the roll.

Jet supports 14 and 15 are mounted around, and spaced apart from, rolls 10 and 11; and gas jets 16 and 17 are mounted between rolls 10 and 11 and jet supports -and 15, also, spaced apart from the rolls. Gas jets 16 and 17 generally take the form of small slots in the wall of a steam manifold;— the steam manifold being, in this case, jet supports 14and 15. The slots can be circular or elongate and are usually elongate with a ratio of length to width of 100 or greater. The length is usually aligned perpendicular to the direction of fiber travel through the device. Gas jets 16 and 17 are supplied with heated gas for the heat treatment of this invention. The heated gas is generally superheated steam; but any equivalent medium can be used such as heated nitrogen, air, or other gas. Superheated steam is preferred because it exhibits a comparatively high specific heat. While other gases, such as nitrogen or argon, or the like can be used, oxygen should be avoided. The heated gas is provided in a temperature range of 200° to 660° C.; and at a velocity which assures turbulence in the region of contact with the yarn. The jet velocity is generally from about 2.5 to 6 meters per second; but lower or higher velocities can be used with appropriate adjustment of yarn speed.

Figure 2:
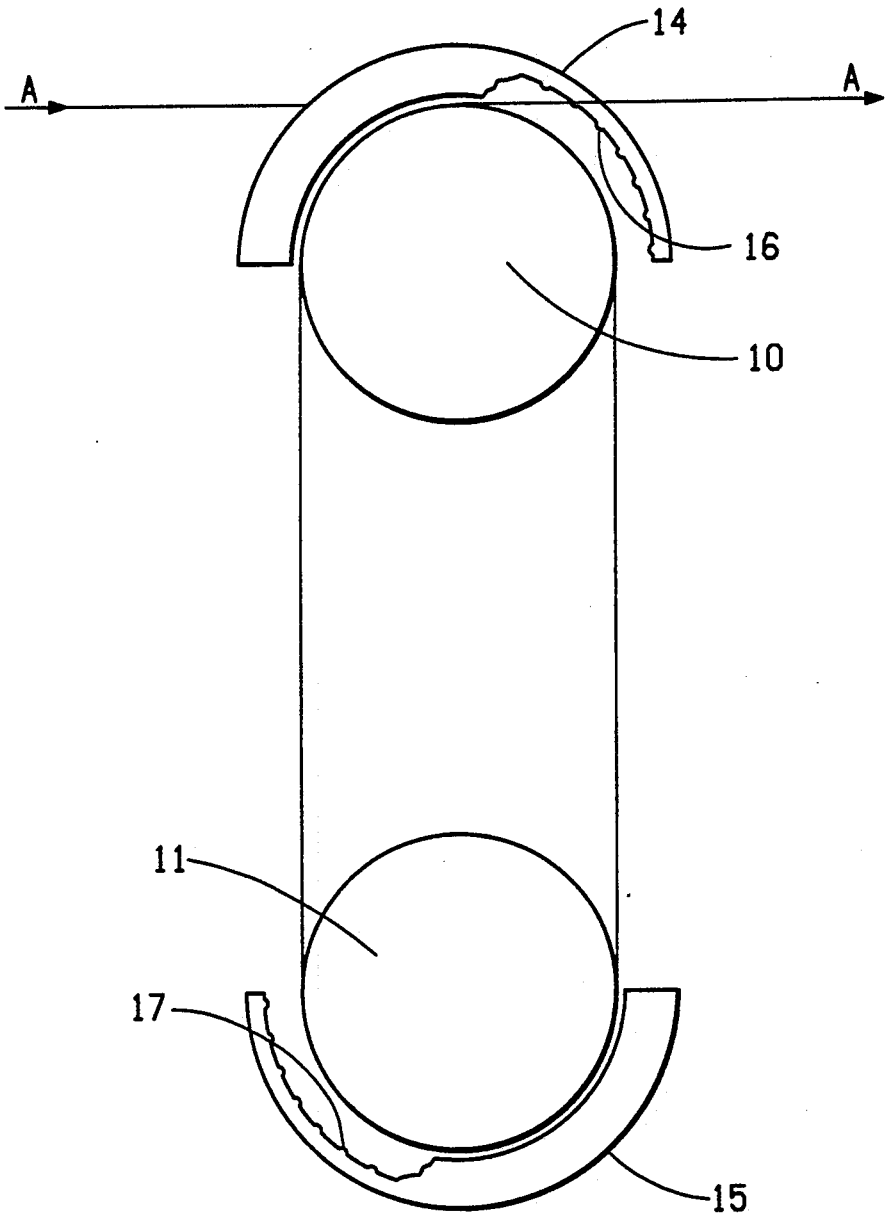
FIG. 2 is a simplified representation of an apparatus of this invention showing a more detailed relationship between fiber carriers and heat treating means.

Looking to FIG. 2 for additional detail, the space between gas jets 16 and 17 and rolls 10 and 11 is constant and is generally maintained at about 2 to about 80 times the width of the individual slots. The preferred spacing is about 10 times the width of the individual slots. The distance, of course, is adjustable depending on the particular need for each situation. Jet supports 14 and 15 serve as heat treatment supply means and mounting fixtures for the gas jets and are situated to direct the heat treatment gas against the fibers being treated.

The jet supports and the gas jets are constructed to conform to the diameter of the fiber carrying rolls and are constructed to extend along the surface of the rolls to a degree adequate to accomplish the desired heat treatment. In some cases, in a two roll device, the heat treatment can be accomplished by gas jets around only one roll; but, generally, gas jets are placed around both rolls and they extend around each roll for about 45° to 180° .

The process of this invention provides an efficient means for drying and heat treating never-dried yarns, on-line, directly from the fiber spinning without slowing the spinning to accommodate the drying. Conducted on-line, the process eliminates the inconvenience and inefficiencies of off-line, batch, treatment processes. Also, this on-line process provides improved fiber properties by eliminating fiber damage caused by the fiber handling of off-line treatments.

The novel combination of internally-heated rolls for drying and turbulent gas jets for heat treating result in heat treated fibers having physical properties at least as good as, and in some ways better than, heat treated fibers of the prior art.

Test Procedures

Inherent Viscosity

Inherent Viscosity (IV) is defined by the equation:

$$IV = \ln(\eta_{rel})/c$$

where c is the concentration (0.5 gram of polymer in 100 ml of solvent) of the polymer solution and $\eta_{rel}$ (relative viscosity) is the ratio between the flow times of the polymer solution and the solvent as measured at 30° C. in a capillary viscometer. The inherent viscosity values reported and specified herein are determined using concentrated sulfuric acid (96% $H_2SO_4$).

Tensile Properties

Yarns tested for tensile properties are, first, conditioned and, then, twisted to a twist multiplier of 1.1. The twist multiplier (TM) of a yarn is defined as:

$$TM = \frac{tpi\sqrt{\text{Denier}}}{73} = \frac{tpc\sqrt{dtex}}{30.3}$$

wherein tpi = turns per inch and
tpc = turns per centimeter.

Tenacity (breaking tenacity), elongation (breaking elongation), and modulus are determined by breaking test yarns on an Instron tester (Instron Engineering Corp., Canton, MA).

Tenacity and elongation are determined in accordance with ASTM D2101-1985 using sample yarn lengths of 25.4 cm and a rate of 50% strain/min.

The modulus for a yarn is calculated from the slope of the secant at 0 and 1% strains on the stress-strain curve and is equal to the stress in grams at 1% strain (absolute) times 100, divided by the test yarn denier.

Denier

The denier of a yarn is determined by weighing a known length of the yarn. Denier is defined as the weight, in grams, of 9000 meters of the yarn.

In actual practice, the measured denier of a yarn sample, test conditions and sample identification are fed into a computer before the start of a test; the computer records the load-elongation curve of the yarn as the yarn is elongated to break and then calculates the properties.

Yarn Moisture

The amount of moisture included in a test yarn is determined by drying a weighed amount of wet yarn at 160° C. for 1 hour and then dividing the weight of the water removed by the weight of the dry yarn and multiplying by 100.

Moisture Regain

The moisture regain of a yarn, preconditioned in an oven at 105° C. for 4 hours, is the amount of moisture absorbed in a period of 24 hours at 77° F. and 55% relative humidity, expressed as a percentage of the dry weight of the fiber. Dry weight of the fiber is determined after heating the fiber at 105-110° C. for at least two hours and cooling it in a desiccator.

Equilibrium Moisture Content

The equilibrium moisture content of a yarn is determined by conditioning a skein of about five grams of the yarn to be tested at 55% relative humidity and 77° F. for 16 hours; weighing the yarn ($W_0$); drying the yarn for 4 hours at 105° C. and weighing it again ($W_1$); and calculating the percent loss in moisture as equilibrium moisture content (%):

$$\% = [(W_0 - W_1)/W_1] \times 100$$

An average of at least two tests is reported.

Heat Aged Strength Retention (HASR)

The heat aged strength retention of a yarn is the percent of the original breaking strength which is retained in the yarn after a controlled heat treatment. A portion of the yarn to be tested is conditioned at 55% relative humidity and 77° F. for 16 hours and the breaking strength of that yarn is determined ($B_0$). A portion of that yarn is heated at 240° C. for 3 hours and is then conditioned at 55% relative humidity and 77° F. for 14 hours before determining the breaking strength of the heated yarn ($B_1$). The Heat Aged Strength Retention is calculated as:

$$HASR = [B_1/B_0] \times 100$$

An average of at least five tests is reported.

Description of the Preferred Embodiment

This example demonstrates the use of a two-roll drying and heat treating device of this invention to make high modulus, low moisture regain yarns.

A spin dope was prepared from poly(p-phenylene terephthalamide) and 100.1% $H_2SO_4$ to provide an anisotropic dope containing 19.4%, by weight, polymer. The dope was deaerated and was, then, air gap spun at 80° C. through spinnerets having 667 and 1000 holes, each with holes of 0.0635mm diameter. The air gap was 6.4mm, and the coagulating bath was 5° C. water containing 4%, by weight, sulfuric acid. The coagulating bath was used with the quenching device which is described in U. S. Pat. No. 4,340,559 with a liquid jetting device as set out in its claim 4. Yarn was withdrawn from the quench bath at 300 yards per minute and at 650 yards per minute; and was washed and neutralized on two sets of rolls with water spray on the first and with dilute caustic spray on the second. The small spinneret was used for items 1 through 10 in Table 1 and the large spinneret was used for items 11 through 14. The yarn tension was 0.9 grams per denier on the washing rolls and 0.8 grams per denier on the neutralizing rolls.

From the neutralizing rolls, the yarn was passed through dewatering pins and onto a device as pictured in FIGS. 1 and 2. Both of the rolls were driven and both were heated internally by saturated steam at 175° C. The gas jets were supplied with superheated steam as noted in Table 1, below. The gas jets were slots with a long axis of 20 inches and a short axis of 0.05 inch arranged with the long axis perpendicular to the direction of yarn travel. The gas jets were present at a spacing of about 0.7 inch (1.78cm) between jets. The gas jets extended for about 180 degrees around both of the rolls and the jets were positioned 0.5 inch from the surface of the rolls.

The tension on the yarn at the beginning of drying-/heat treating device was from 1 to 3 grams per denier (gpd), as specified in Table 1, below; and he tension on the yarn exiting the device was about 0.2 to 0.5 gpd.

The fibers of this example showed high modulus nd a low equilibrium moisture content. Test results shown in Table 2, below.

In the Tables below, Items 1, 3, 9, and 11 are Controls in the sense that those items were run without heat treating by means of the gas jets.

TABLE 1

| | Drying and Heat Treating Conditions | | | | |
|---|---|---|---|---|---|
| | | | Superheated Steam Cond. | | |
| Item # | Yarn Denier | Spinning Speed (YpM) | Temp. (°C.) | Jet Veloc. (mps) | Yarn Tension (gpd) |
| 1 | 1000 | 650 | N/A* | N/A | 1.5 |
| 2 | 1000 | 650 | 380 | 4.1 | 1.5 |
| 3 | 1000 | 650 | N/A | N/A | 3.0 |
| 4 | 1000 | 650 | 225 | 4.1 | 3.0 |
| 5 | 1000 | 650 | 300 | 4.1 | 3.0 |
| 6 | 1000 | 650 | 350 | 4.1 | 3.0 |
| 7 | 1000 | 650 | 380 | 3.5 | 3.0 |
| 8 | 1000 | 650 | 380 | 4.1 | 3.0 |
| 9 | 1000 | 300 | N/A | N/A | 3.0 |
| 10 | 1000 | 300 | 380 | 4.1 | 3.0 |
| 11 | 1420 | 300 | N/A | N/A | 2.0 |
| 12 | 1420 | 300 | 380 | 4.1 | 1.0 |
| 13 | 1420 | 300 | 380 | 4.1 | 2.0 |
| 14 | 1420 | 300 | 380 | 4.1 | 3.0 |

*N/A indicates that the steam was not applied for heat treating.

TABLE 2

| | Yarn Properties | | | | |
|---|---|---|---|---|---|
| Item # | Ten. (gpd) | Mod. (gpd) | E.B. (%) | HASR (%) | Equil. Moist. |
| 1 | 24.2 | 690 | 3.17 | 85 | 6.4 |
| 2 | 22.2 | 912 | 2.29 | 91 | 2.8 |
| 3 | 23.2 | 819 | 2.70 | 85 | 6.3 |
| 4 | 23.9 | 811 | 2.74 | 94 | 6.6 |
| 5 | 23.5 | 861 | 2.53 | 96 | 4.1 |
| 6 | 22.9 | 894 | 2.40 | 99 | 3.0 |
| 7 | 23.2 | 900 | 2.40 | 93 | 2.9 |
| 8 | 23.3 | 927 | 2.37 | 98 | 2.9 |
| 9 | 26.9 | 874 | 2.92 | 85 | 4.6 |
| 10 | 24.6 | 946 | 2.54 | 85 | 2.5 |
| 11 | 25.9 | 658 | 3.53 | 90 | 4.7 |
| 12 | 23.7 | 724 | 2.97 | 94 | 2.5 |
| 13 | 25.0 | 881 | 2.72 | 96 | 2.5 |
| 14 | 24.8 | 933 | 2.57 | 95 | 2.5 |

I claim:

1. A process for simultaneously drying and heat treating under tension wet spun fibers comprising:
   (a) supplying continuously by means of a pair of fiber carrying rolls to a heated zone fibers of greater than 20 percent water based on weight of dry fiber material;
   (b) conducting the fibers in the heated zone in multiple wraps around the pair of rolls;
   (c) maintaining a tension of 0.2 to 6 grams per denier to the fibers at the beginning of the zone;
   (d) directing turbulent gas at a temperature of 200 to 600° C. by means of gas jets extending around each of the rolls for about 45 to 180° against the fibers under tension in the zone until the residual moisture in the fibers is from 0.5 to 10 percent water based on weight of dry fiber material;
   (e) removing continuously the fibers from the heated zone.

2. The process of claim 1 wherein heat is supplied to the heated zone by the turbulent gas and additionally, by a heated medium inside at least one roll of the pair of rolls.

3. The process of claim 1 where the tension on fibers continuously remvoed from the heated zone is no greater than the tension on the fibers at the beginning of the heater zone.

4. A process for simultaneously drying and heat treating under tension wet spun aramid fibers comprising:
   (a) supplying continuously by means of a pair of fiber carrying rolls to a heated zone aramid fibers of greater than 20 percent water based on weight of dry fiber material;
   (b) conducting the fibers in the heated zone in multiple wraps around the pair of rolls;
   (c) maintaining a tension of 0.2 to 6 grams per denier to the fibers at the beginning of the zone;
   (d) directing turbulent has at a temperature of 200 to 600° C. by means of gas jets extending around each of the rolls for about 45 tp 180° against the fibers under tension in the zone until the residual moisture in the fibers is from 0.5 to 10 percent water based on weight of dry fiber material;
   (e) removing continuously the fibers from the heated zone.

5. The process of claim 4 wherein heat is supplied to the heated zone by the turbulent gas and additionally, by a heated medium inside at least one roll of the pair of rolls.

6. The process of claim 4 where the tension on fibers continuously removed from the heated zone is no greater than the tension on the fibers at the beginning of the heated zone.

7. The process of claim 4 wherein the aramid fibers are fibers of poly(p-phenylene terephthalamide).

8. The process of claim 4 wherein heat is supplied to the heated zone by the turbulent gas and additionaly, by a heated medium inside each roll in the pair of rolls.

9. The process of claim 1 wherein heat is supplied to the heated zone by the turbulent gas and additionally, by a heated medium inside each roll in the pair of rolls.

* * * * *

UNITED STATES PATENT OFFICE

CERTIFICATE OF CORRECTION

PATENT NO. : 5,009,830
DATED : April 23, 1991
INVENTOR(S) : Terry S. Chern

It is certified that error appears in the above-identified patent and that said Letters Patent is hereby corrected as shown below:

In the Claims:

Claim 3, column 8, line 20, delete the word "heater" and substitute --heated-- therefor Claim 4, column 8, line 33, delete "tp" and substitute --to-- therefor.

Signed and Sealed this

Twenty-seventh Day of October, 1992

*Attest:*

DOUGLAS B. COMER

*Attesting Officer*

*Acting Commissioner of Patents and Trademarks*